United States Patent [19]

Matsumoto

[11] 4,186,771

[45] Feb. 5, 1980

[54] HYDRAULIC CONTROL APPARATUS

[75] Inventor: Kazumasa Matsumoto, Itami, Japan

[73] Assignee: Sanyo Kiki Kabushiki Kaisha, Hyogo, Japan

[21] Appl. No.: 848,326

[22] Filed: Nov. 3, 1977

[51] Int. Cl.[2] ..... F15B 13/06

[52] U.S. Cl. ..... 137/596.17; 91/527; 251/129; 251/337

[58] Field of Search ..... 91/527, 531; 137/596.17; 251/129, 337

[56] References Cited

U.S. PATENT DOCUMENTS

| | | | |
|---|---|---|---|
| 2,436,992 | 3/1948 | Ernst | 251/129 X |
| 3,429,552 | 2/1969 | Huley et al. | 251/129 |
| 3,793,831 | 2/1974 | Khatti | 91/527 X |

*Primary Examiner*—Gerald A. Michalsky

*Attorney, Agent, or Firm*—Armstrong, Nikaido, Marmelstein & Kubovcik

[57] ABSTRACT

An apparatus for controlling the hydraulic system of hydraulic actuators, such as hydraulic cylinders. The apparatus is constituted only by a combination of two kinds of control valves in that normally opened and normally closed, solenoid-operated, spring-returned type control valves are serially connected together through a common port formed in each control valve.

3 Claims, 18 Drawing Figures

NO
1
2
5
5'
6

NC
7
8
14'
15'
16'
17'
18'

NO
1
9
10
11
12
II
II 1
2
3
3'
4
4'
5'
9
12
13
14
15
16
17
19
20
21
22
23
24
25
26
27
28
29
30
31
32
33
34
35

NC5
NC6
NC3
NC4
NC1
NC2
NO3
NO4
NO1
NO2
SOL-1
SOL-2
SOL-3
SOL-4
SOL-5
SOL-6
SOL-7
SOL-8
SOL-9
SOL-10
P
T
R
S
V

NC2
NO4
NO2
NO1
NO3
NC1
FROM OIL PUMP
TO OIL TANK

B9
A9
B8
A8
B7
A7
S
T
SOL-19
SOL-18
SOL-17
SOL-16
SOL-15
NO7
NO6
NC12
NC11
NC10
a9 C9 b9
a8 C8 b8
a7 C7 b7
48'
47'
48
47
R
P
T

B6
A6
B5
A5
B4
A4
S
T
SOL-14
SOL-13
SOL-12
SOL-11
NO5
NC9
NC8
NC7
a6 C6 b6
a5 C5 b5
a4 C4 b4
46
45
44
43
42
41
40
39
R
P
T

NC12
NC11
NC10
NO7
NO6
SOL-19
SOL-18
SOL-17
SOL-16
SOL-15
A9
B9
A8
B8
A7
B7
S
T
P
R
M
47
48
48'
47'

NC12
NC11
NC10
NO7
NO6
SOL-19
SOL-18
SOL-17
SOL-16
SOL-15
A9
B9
A8
B8
A7
B7
S
T
P
R
M
47
48
48'
47'

HYDRAULIC CONTROL APPARATUS

BACKGROUND OF THE INVENTION

The present invention relates to a hydraulic control apparatus for the hydraulic system of hydraulic actuators, such as hydraulic cylinders.

In these days, the control of hydraulic systems in vehicles including agricultural and construction machines has a tendency to be carried out by using solenoid-operated switching valves in order to meet requirements for higher efficiency and higher accuracy of operation, for remote-controlled operation and for the compounding of operations. However, solenoid switching valves heretofore in use are large-sized, expensive and unreliable, and moreover they can hardly be applied to multi-control.

SUMMARY OF THE INVENTION

The present invention provides a hydraulic control apparatus meeting such demand, wherein a plurality of opening and closing mechanisms of which a directional control valve is originally possessed are divided into two kinds of normally opened and normally closed solenoid-operated control valves which are simple in cross-sectional shape and small in size to facilitate the machining of said directional control valve, said solenoid-operated control valves being used in combination with various electric and hydraulic circuits so as to effect the intended control of hydraulic actuators.

According to a feature of the invention, each control valve comprises a valve body which is substantially rectangular parallelepipedic and which has a round through-hole, and a sleeve having land portions adapted to be axially slidably fitted in said round through-hole and having substantially the same diameter as that said round hole with oil sealed therebetween, and a reduced portion which is smaller in diameter than said land portions and round hole, allowing passage of oil therebetween. The valve body or sleeve has a port extending between opposed lateral surfaces and communicating with said round hole, and a port communicating with said round hole at a positions axially spaced away from the first-mentioned port and opening to another surface. When a plurality of said control valves are connected, the former ports communicate with each other between adjacent control valves to allow series connection of these valves.

According to another feature of the invention, in a hydraulic control apparatus, normally closed valves are provided in association with respective objects to be controlled, i.e., hydraulic actuators, while normally opened control valves constitute a predetermined basic circuit irrespective of the number of hydraulic actuators. The basic circuit and the normally closed control valves may be stacked as an integral type or alternatively they may be separately installed so that the basic circuit is installed on a suitable operating board while the normally closed control valves are installed integral with or in the vicinity of their respective hydraulic actuators. In either case, the series connection of these control valves provides a remarkable effect of reducing or simplifying the connector pipes used in a hydraulic control apparatus.

The hydraulic control apparatus according to the invention is capable of performing various types of control, in addition to the direction control of pressure oil, by adding to its circuit a valve having a function other than NO and NC.

These and other features of the invention will become more apparent from the following description, when taken in conjunction with the accompanying drawings.

DESCRIPTION OF THE PREFERRED EMBODIMENTS

First of all, control valves used in a hydraulic control apparatus according to the present invention will be described.

Figure 1:
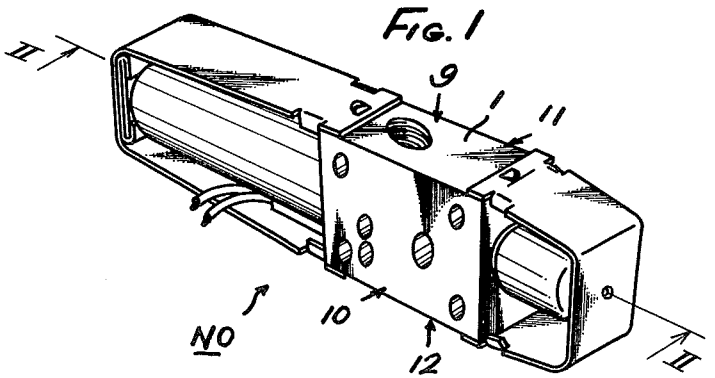
FIG. 1 is a perspective view of a normally opened control valve used in a hydraulic control apparatus according to the present invention.
Figure 2:
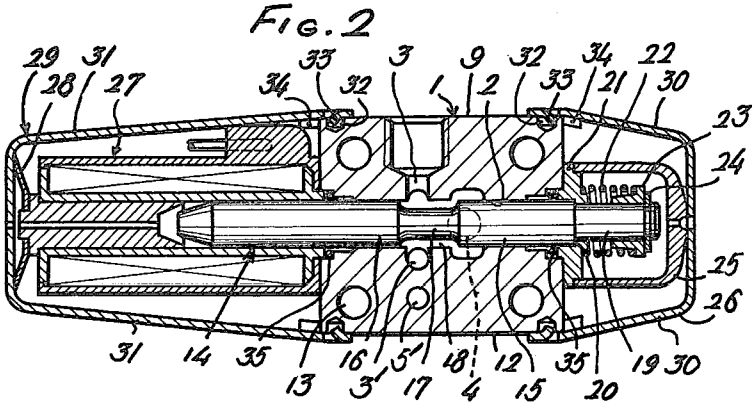
FIG. 2 is sectional view taken along the line II—II of FIG. 1.

Referring to FIGS. 1 and 2, a normally opened valve is shown at NO. Designated at 1 is a valve body or sleeve which is rectangular parallelepipedic and has an axially extending round hole 2. There is formed a port 3 which opens to an upper surface 9, which is among four surfaces 9, 10, 11 and 12 parallel to the axis of the round hole 2, and communicates at its inner end with the round hole 2. At a position axially spaced away from said port 3, there is formed a port 4 which extends at right angles with both the round hole 2 and port 3 and opens to opposed lateral surfaces 10 and 11 of the sleeve 1. There is formed a port 3' which communicates with the port 3 at the terminal end thereof, extends parallel to the port 4 and opens to said opposed lateral surfaces 10 and 11 of the sleeve 1. Through-holes 13 opening to the opposed lateral surfaces 10 and 11 of the sleeve 1 and disposed at four corners are used for receiving control valve connecting bolts in stacking operation.

A spool 14 is axially slidably fitted in the round hole 2 of the sleeve 1, and comprises land portions 15 and 16 which are substantially the same in diameter as the round hole 2 and allows oil to be sealed therebetween, and a reduced portion 17 which is smaller in diameter than the round hole 2 and cooperates with the latter to define a passage 18 for oil. The opposite ends of the spool 14 project outwardly of the sleeve 1.

At one end of the spool 14, there is an extension 19 outwardly projecting from the land portion 15, and a shoulder 20 on the land portion 15 is engageable with a seat 21 fitted in one end of the round hole 2. Mounted on the extension 19 is a compression spring 22 held between the seat 21 and a spring receiver 23 secured by a snap ring 24. Designated at 25 is a protective case for the spring, which is held at one end surface of the sleeve 1 by a cover or clamp 26. On the other hand, at the other end of the spool 14, a solenoid 27 comprising a soil enclosed in a case is held at the other end surface of the sleeve 1 by a cover or clamp 29 with a spring plate 28 interposed therebetween.

Each of the covers or clamps 26 and 29 is bent into a U-shape in such a manner that the distance between the side plates 30 or 31 is less than the thickness of the sleeve 1 as measured between the upper and lower surfaces 9 and 12. Therefore, these clamps can be installed on the sleeve under their own resilience when fitted thereover with their side plates forced apart. In this connection, in order to fix the clamps to the sleeve, recesses 32 and projections 33 engageable therewith are formed at corresponding positions on the upper and lower surfaces 9 and 12 of the sleeve and on the side plates of the clamps. Further, since only the engagement between the projections 33 and the recess 32 is insufficient to prevent the transverse or lateral swing of the clamps when the latter are mounted on the sleeve, the clamps are cut to form raised tabs 34 adapted to abut against the end surfaces of the sleeve 1 so as to prevent said transverse or lateral swing.

With such assemblying system using the covers or clamps 26 and 29, as compared with the conventional system using set-screws or the like, it is possible to reduce the number of steps for manufacture and assembly and simplify the operation. Further, since the clamps are U-shaped and its width as measured between the end surfaces is less than or equal to the width of the sleeve, there is no trouble in stacking or connecting the sleeves.

Designated at 35 is an O-ring or oil seal means for prevention of oil leakage.

In this normally opened control valve NO, the spool 14 is normally urged by the spring 22 so that the shoulder 20 on the land portion 15 is engaged with the seat 21. That is, in the illustrated normal condition, the ports 3 and 4 communicate with each other through the passage 18 around the reduced portion 17. Upon passage of electric current, the solenoid 27 is energized to move the spool 14 to the left as viewed in FIG. 2 against the resilience of the spring 22, thereby blocking the passage of oil between the ports 3 and 4. However, as soon as the electric current is cut off to deenergize the solenoid 27, the spool 14 is returned to its original position by the resilience of the spring so that the ports 3 and 4 again communicate with each other through the passage 18. The port 3' is always in communication with the port 3 irrespective of the movement of the spool 14.

Figure 3:
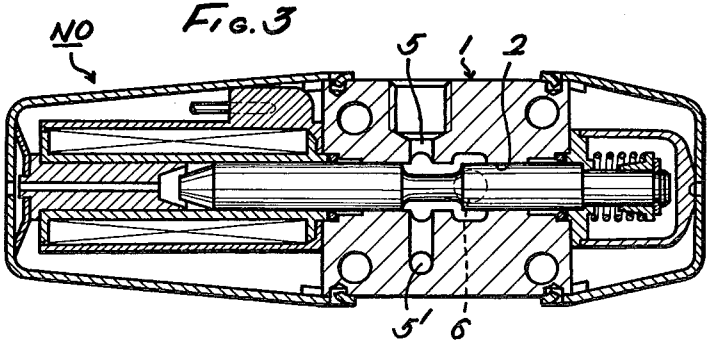
FIG. 3 is a longitudinal section of another normally opened control valve used in a hydraulic control apparatus according to the invention.

FIG. 3 shows another normally opened control valve which differs from the above-described control valve only in the position of a port 5' corresponding to the port 3'. The port 5' is always in communication with a port 5 irrespective of the movement of the spool 14.

Figure 4:
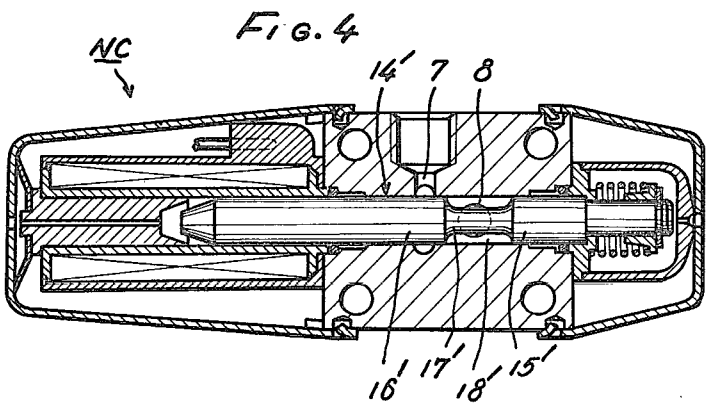
FIG. 4 is a side view, in longitudinal section, of a normally closed control valve used in a hydraulic control apparatus according to the invention.

FIG. 4 shows a normally closed control valve, whose components are substantially the same as those of the above-described normally opened control valve NO but differ in thier disposition. That is, in the illustrated normal condition, a port 7 is closed by a land portion 16' of the spool. Upon passage of electric current, a solenoid 27 is energized to move the spool 14' to the left as viewed in the Figure against the resilience of a spring 22, whereby the port 7 communicates with a port 8 through a passge 18' around a reduced portion 17'. As soon as the electric current is cut off to remove the external attracting force exerted by the solenoid 27, the spool 14' is returned to its original position by the resilience of the spring 22 so that the port 7 is again closed by the land portion 16'.

Figure 5:
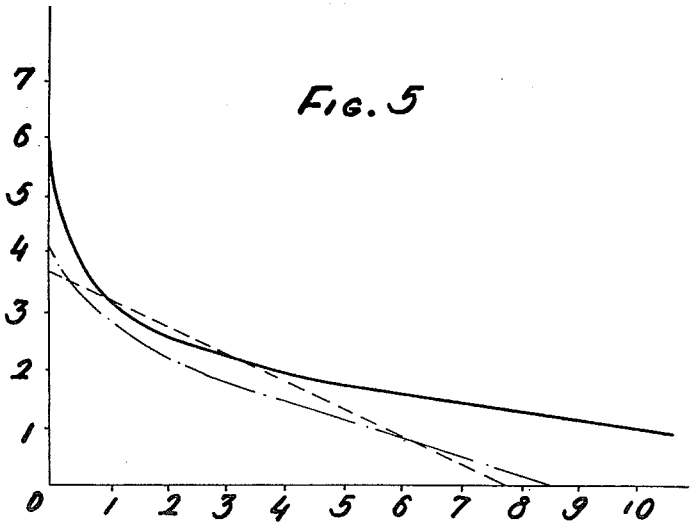
FIG. 5 is a graph showing the relation between the spool attracting characteristic of a solenoid and the spring characteristic of a spool returning spring in a solenoid-operated spring return type control valve.

The relation between the spool attracting characteristic of the solenoid and the spring characteristic of the spool returning spring in the solenoid-operated, spring-returned type control valves will now be considered with reference to FIG. 5.

The solenoid has an attracting characteristic as shown in a solid line, while the cylindrical coil spring 22 has a spring characteristic as shown in a dotted line. If such cylindrical spring is used as the spool returning spring, in a stroke range of 1—3 mm the restoring force of the cylindrical coil spring exceeds the attracting force of the solenoid, so that there would occur a phenomenon in which the spool will not be moved despite the energization of the solenoid. Further, even if a cylindrical coil spring whose spring characteristic is such that its restoring force is always below the attracting force of the solenoid is used, the difference between the restoring force and the attracting force is not uniform throughout the stroke, thus causing a disadvantage that the operation of the spool which is the most important to the function of this kind of control valve cannot be smoothly carried out. Moreover, since the solenoid used in such control valve is energized by a small battery as used in automobiles or the like, a cylindrical coil spring with a low spring characteristic is, of course, required. The manufacture of such spring is by no means easy.

Figure 6:
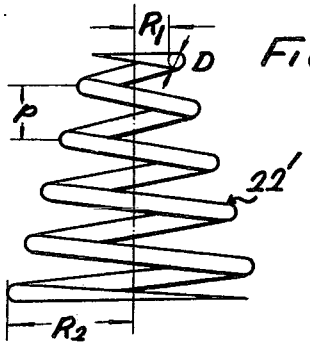
FIG. 6 is a front view of a conical coil spring.

Now, as an example of a spool returning spring having a spring characteristic resembling the attraction characteristic of the solenoid and assuring the smooth operation of the spool, a conical coil spring 22' as shown in FIG. 6 may be cited. The spring characteristic of a conical coil spring, as shown in an alternate long-and-short-dash line in FIG. 5, draws a curve similar to that for the attraction characteristic of the solenoid. If, therefore, it is adjusted so that the restoring force is always below the attracting force of the solenoid, then the difference between the two is uniform throughout the stroke, assuring the smooth operation of the spool. The characteristic of a conical coil spring can be easily adjusted by varying any one of the factors, i.e., wire diameter D, pitch p, smallest coil mean radius R1 and largest coil mean radius R2.

Figure 7:
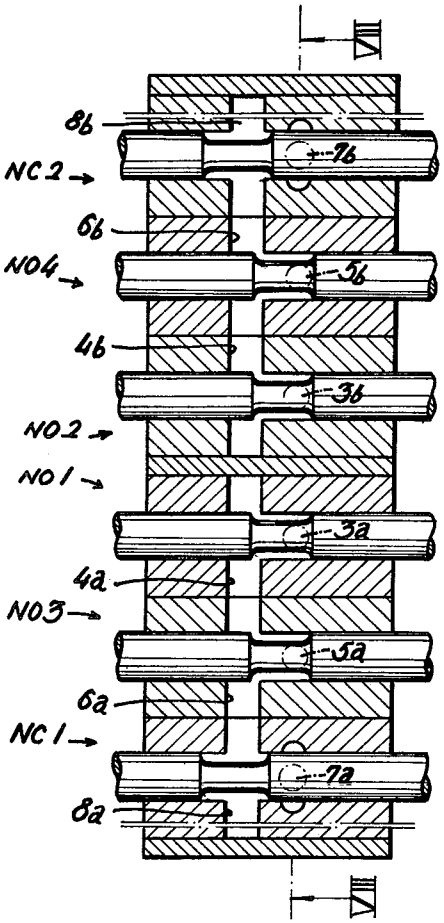
FIG. 7 is a plan view, in longitudinal section, showing how the control valves shown in FIGS. 1 through 4 are stacked.
Figure 8:
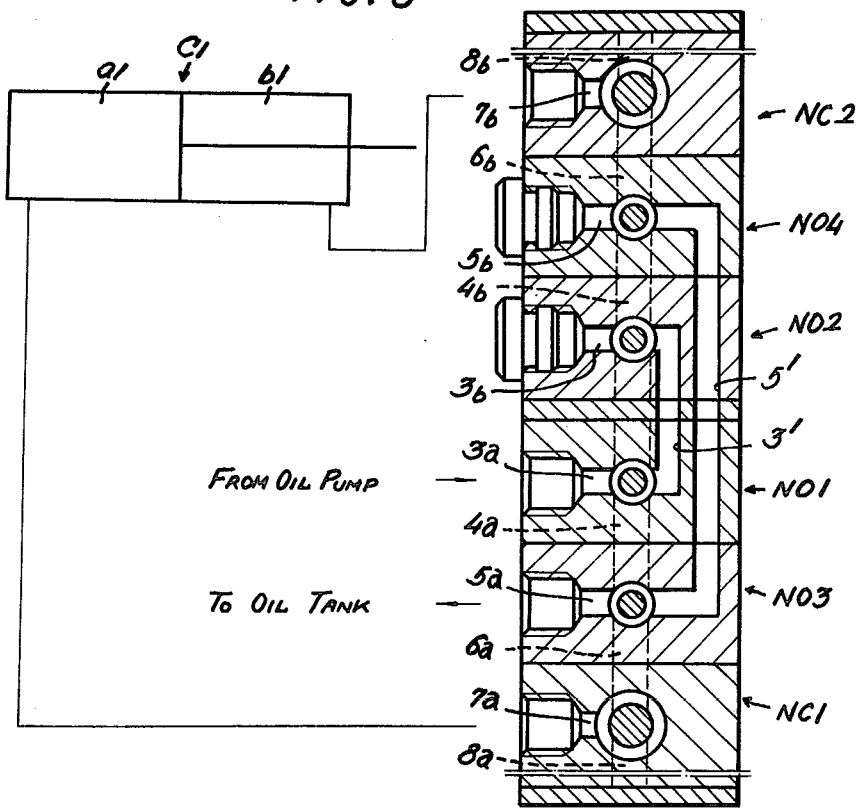
FIG. 8 is a sectional view taken along the line VIII--VIII of FIG. 7.

The manner in which the normally opened and normally closed control valves are stacked will now be described with reference to FIGS. 7 and 8. When it is desired to control the hydraulic system of double-acting cylinders, four normally opened control valves NO1--NO4 are used to form a basic circuit. For each cylinder, there are provided two normally closed control valves. For example, for a cylinder C1, there are provided normally closed control valves NC1 and NC2 connected to its rear piston chamber a1 and front piston chamber b1 through the ports 7*a* and 7*b*, respectively. These control valves have ports 4*a*, 4*b*, 6*a*, 6*b*, 8*a*, 8*b*, which open to opposed lateral surfaces of the respective sleeves so as to be aligned with each other when the valves are stacked, said ports forming a series of common ports which always communicate with each other irrespective of the movement of the respective spools. The ports 3′ and 5′ establish communication between the ports 3*a* and 3*b* and between the ports 5*a* and 5*b*, respectively, whereby the piping between the basic circuit, hydraulic pump and oil tank is facilitated.

Thus, it will be understood that according to the present invention, even when many double-acting hydraulic cylinders must be controlled, the intended hydraulic control apparatus can be constituted by simply stacking normally closed control valves coresponding in number to the hydraulic cylinders on the basic circuit comprising four normally opened control valves. A hydraulic control apparatus according to an embodiment of the invention will now be described with reference to an electric-hydraulic combination circuit.

I

Figure 9:
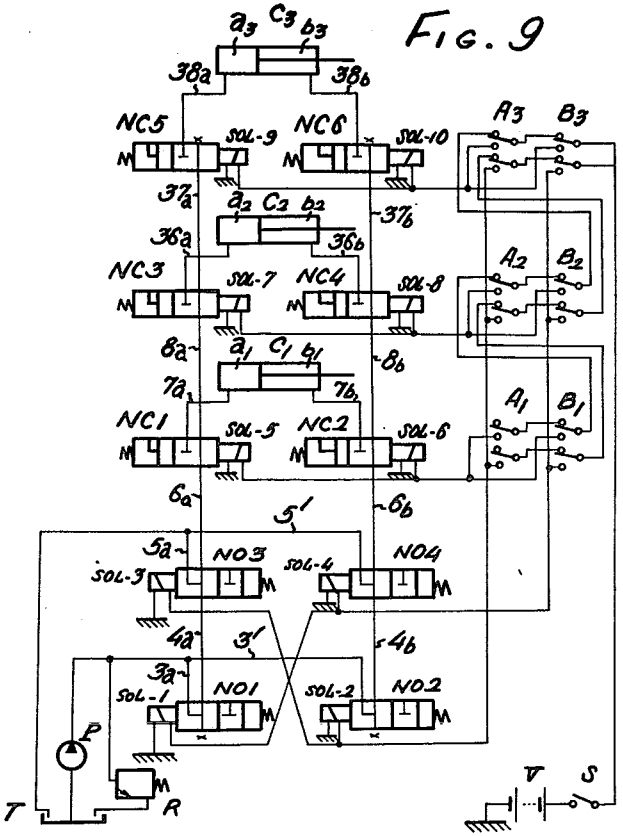
FIG. 9 is an electric-hydraulic combination circuit diagram showing an embodiment of a hydraulic control apparatus according to the invention.

In FIG. 9, NO1–NO4 designate normally opened control valves; NC1–NC6 designate normally closed control valves; and C1–C3 designate double-acting hydraulic cylinders. The normally closed control valves NC1, NC3 and NC5 are connected to the rear piston chambers a1, a2 and a3 of the hydraulic cylinders C1, C2 and C3 through the ports 7*a*, 36*a* and 38*a*, respectively. The control valves NC2, NC4 and NC6 are connected to the front piston chambers b1, b2 and b3 through the ports 7*b*, 36*b* and 38*b*, respectively. Designated at T is an oil tank. Oil is fed to the hydraulic system by an oil pump P, while the oil pressure is controlled to a specified pressure value by a relief valve R placed in the piping. Designated at SOL-1 through SOL-10 are solenoids for the control valves.

Further, A1 and B1 designate push-button switches for operating the hydraulic cylinder C1; A2 and B2 designate push-button switches for operating the hydraulic cylinder C2; and A3 and B3 designate push-button switches for operating the hydraulic cylinder C3. The push-button switches A1–A3 are used for extending the piston rods of the hydraulic cylinders C1–C3 while the push-button switches B1–B3 are used for retracting the piston rods of the hydraulic cylinders C1–C3. Designated at V is a power source and S is a power switch.

The above refers to the hydraulic and electric circuit arrangement in the hydraulic control apparatus, and the operation thereof will now be described. In the condition shown in FIG. 9, the normally opened control valves NO1–NO4 are opened while the normally closed control valves NC1–NC6 are closed, with no pressure oil fed from the hydraulic pump P to the hydraulic cylinders C1–C3.

Figure 10:
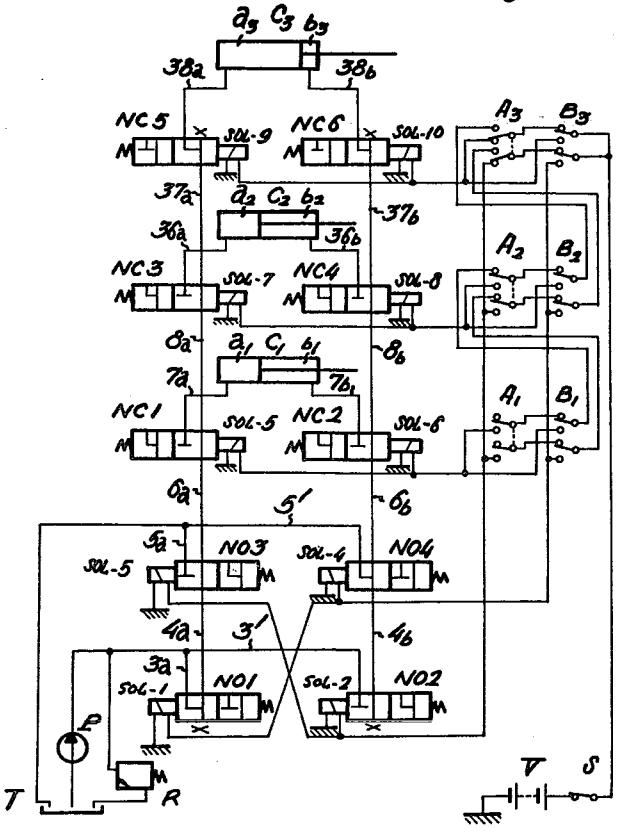

In order to start a hydraulic cylinder, e.g., C3 from this condition, the power switch S is first turned on. The push-button switch A3 is then turned on, whereupon the solenoids SOL-2, SOL-3, SOL-9 and SOL-10 are energized to move the spools, thereby switching the control valves NO2, NO3, NC5 and NC6, as shown in FIG. 10. As a result, the pressure oil from the pump P flows through the port 3*a* into the control valve NO1, then through common ports designated at 4*a*, 6*a*, 8*a* and 37*a* and through the port 38*a* of the control valve NC5 into the rear chamber a3 of the cylinder C3. The oil in the front chamber b3 flows through the port 38*b* of the control valve NC6 and then through common ports designated at 37*b*, 8*b* and 6*b* into the control valve NO4, from which it then returns to the oil tank T. Therefore, the piston rod of the hydraulic cylinder C3 is extended to the right until the push-button switch A3 is turned off.

When the push-button switch A3 is turned off, the solenoids SOL-2, SOL-3, SOL-9 and SOL-10 are deenergized, so that the respective spools are automatically pushed back by the resilience of the respective springs, thus switching the control valves NO2, NO3, NC5 and NC6 to their normal conditions. Thereafter, no pressure oil is fed to the hydraulic cylinder C3 and hence the piston rod stops extending and is held in its position.

Figure 11:
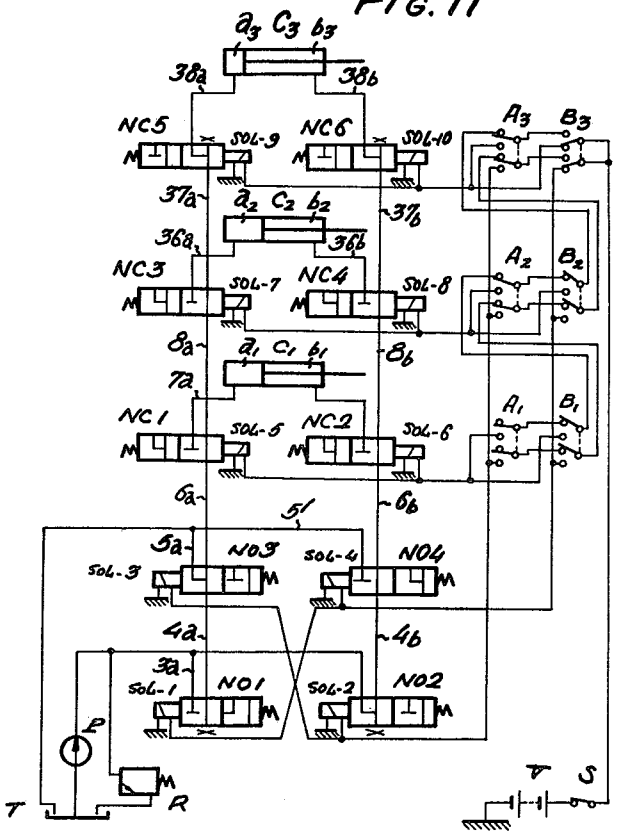
FIGS. 10 and 11 are electric-hydraulic combination circuit diagrams showing the operating conditions of the embodiment shown in FIG. 9.

When it is desired to retract the piston rod, the push-button switch B3 is turned on. Thereupon, the solenoids SOL-1, SOL-4, SOL-9 and SOL-10 are energized to move the respective spools, thereby switching the control valves NO1, NO4, NC5 and NC6, as shown in FIG. 11. As a result, the pressure oil from the hydraulic pump P flows through the port 3′ into the control valve NO2, then through common ports designated at 4*b*, 6*b*, 8*b* and 37*b* and then through the port 38*b* of the control valve NC6 into the front piston chamber b3 of the cylinder C3. On the other hand, the oil in the rear piston chamber a3 flows out of the port 38*a* of the control valve NC5 through common ports designated at 37*a*, 8*a* and 6*a* and then through the port 5*a* of the control valve NO3 back into the oil tank T. Therefore, the piston rod of the cylinder C3 is retracted to the left until the push-button B3 is turned off.

When the push-button B3 is turned off, the solenoids SOL-1, SOL-4, SOL-9 and SOL-10 are deenergized, so that the respective spools are automatically pushed back by the resilience of the respective springs, thus switching the control valves NO1, NO4, NC5 and NC6 to their normal conditions. Thereafter, no pressure oil is fed to the cylinder C3 and hence the piston rod stops retracting and is held in its position.

The above refers to a series of operations of the hydraulic cylinder C3. In the above embodiment, hydraulic cylinders have been provided in three lines. However, it is possible to control any desired number of lines of hydraulic cylinders by connecting in series the same number of pairs of normally closed directional control valves as the number of double-acting hydraulic cylinders, which are objects of control, to a basic circuit comprising four-in-a-set normally opened control valves.

II

Figure 12:
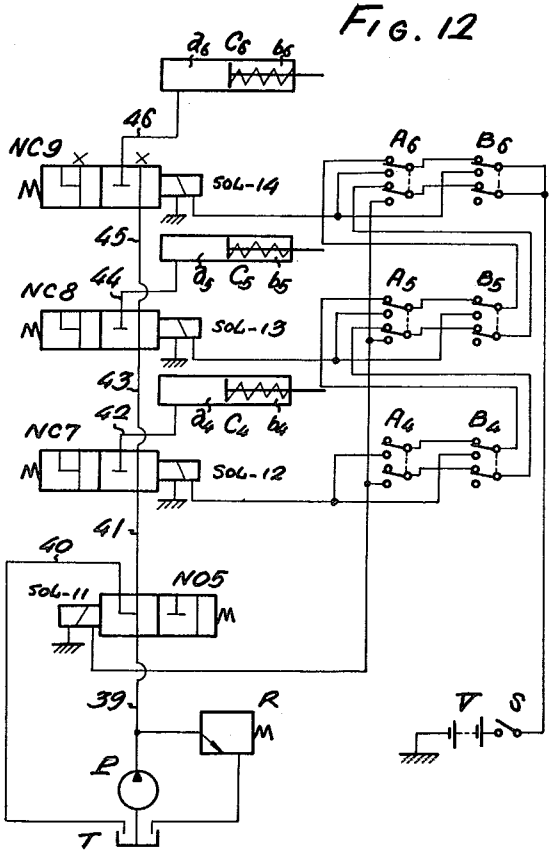
FIG. 12 is an electric-hydraulic combination circuit diagram showing an embodiment of a hydraulic control apparatus of the invention for controlling single-acting cylinders.

Another embodiment of a hydraulic control apparatus which controls single-acting cylinders (ram cylinders) whose piston rods are adapted to be retracted by the resilience of springs or by loads will now be described. In FIG. 12, NO5 designates a normally opened control valves and C4-C6 designate single-acting hydraulic cylinders whose piston rods are adapted to be returned to their original positions by the resilience of springs contained in their front piston chambers. Designated at NC7-NC9 are normally closed control valves connected to the rear piston chambers a4-a6 of the hydraulic cylinders C4-C6 through ports 42, 44 and 46, respectively. The control valves NO5, NC7, NC8 and NC9 are connected in series through common ports designated at 41, 43 and 45, and an operating hydraulic circuit is formed between a hydraulic pump P, an oil tank T and hydraulic cylinders. Further, SOL-11 through SOL-14 designate solenoids for the control valves; A5 and B5 designate push-button switches for the hydraulic cylinder C5; and A6 and B6 designate push-button switches for the hydraulic cylinder C6. The push-button switches A4-A6 are used to extend the piston rods of the hydraulic cylinders C4-C6 and the push-button switches B4-B6 are used to retract the piston rods of the hydraulic cylinders C4-C6. These electric parts are connected as shown to form an operating electric circuit.

In order to control a hydraulic cylinder, e.g., C6, from the normal condition of the arrangement shown in FIG. 12, the power switch S is first turned on. The push-button switch A6 is then turned on, whereupon the solenoids SOL-11 and SOL-14 are energized to move the respective spools against the resilience of the respective springs, thus switching the control valves NO5 and NC9. As a result, the pressure oil from the hydraulic pump P flows out of the port 39 into the control valve NO5, then through common ports designated at 41, 43 and 45 and through the port 46 of the control valve NC9 into the rear chamber a6. Therefore, the piston rod of the hydraulic cylinder C6 is extended to the right against the resilience of the spring installed in the front piston chamber.

When the push-button switch A6 is turned off, the solenoids SOL-11 through SOL-14 are deenergized, so that the spools are automatically pushed back by the springs, thus switching the control valves NO5 and NC9 to their normal conditions. Thereafter, no pressure oil is fed to the hydraulic cylinder C6 and hence the piston rod stops extending and is held in its position.

When it is desired to retract the piston rod, the push-button switch B6 is turned on. Thereupon, the solenoid SOL-14 is energized to switch the control valve NC9. As a result, the piston rod of the hydraulic cylinder C6 is pushed back to the left by the resilience of the spring installed in the front piston chamber b6. At this moment, the oil in the rear piston chamber a6 flows out of the port 46 of the control valve NC9 through common ports designated at 45, 43 and 41 and then through the port 40 of the control valve NO5 back into the oil tank T.

When the push-button B6 is turned off, the solenoid SOL-14 is deenergized to switch the control valve NC9 to its normal condition. Thereafter, the oil does not flow back to the oil tank T so that the piston rod stops retracting and is held in its position.

The above refers to a series of operations of the hydraulic cylinders.

III

In the above embodiments, control of one reciprocating hydraulic cylinder has required at least four normally opened control valves and two normally closed control valves and two more normally closed control valves have been required for each additional cylinder which is an object of control. Therefore, as the number of cylinders increases, connector pipes and electric wires increase in number and become more complicated and the resistance to the flow of oil in the piping increases, thus causing the danger of detracting from the performance.

In order to avoid this disadvantage, a hydraulic control apparatus may be constituted by 6-port 2-position control valves each having an oil passage opening and closing mechanism equivalent to two 3-port 2-position control valves described above. Such embodiment will now be described.

Figure 13:
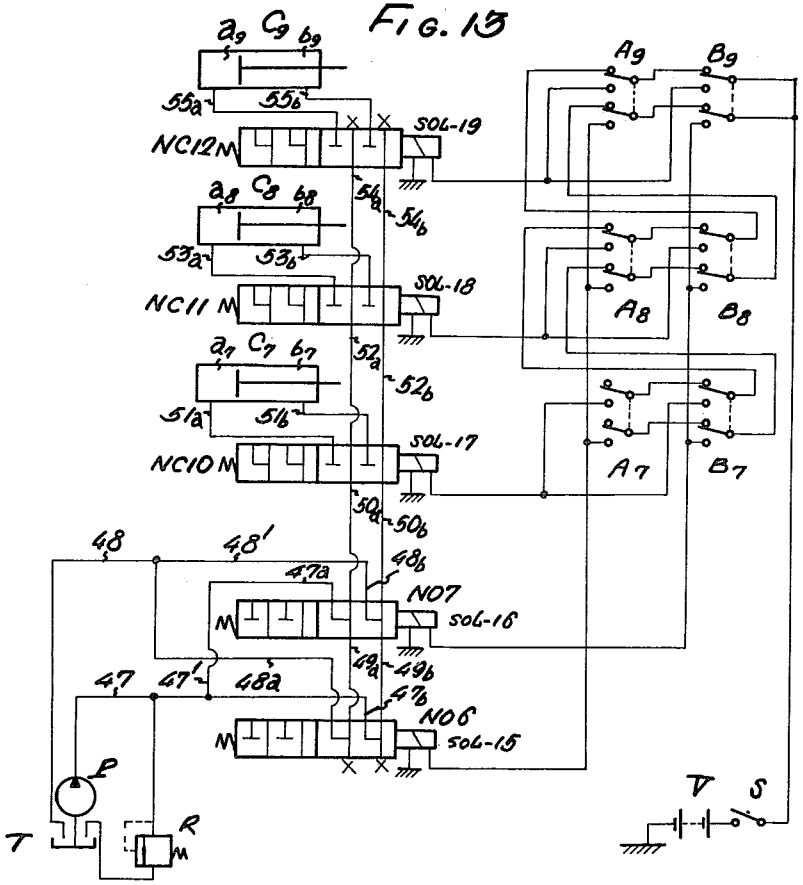
FIG. 13 is an electric-hydraulic combination circuit diagram showing another embodiment of a hydraulic control apparatus according to the invention.

In FIG. 13, NO6 and NO7 designate normally opened control valves which constitute a basic circuit. Further, C7-C9 designate reciprocating hydraulic cylinders, and NC10-NC12 designate normally closed control valves connected to the rear piston chambers a7-a9 of the hydraulic cylinders C7-C9 through the ports 51*a*, 53*a* and 55*a* and also connected to the front piston chambers b7-b9 through the ports 51*b*, 53*b* and 55*b*. These control valves NO6, NO7, NC10, NC11 and NC12 are connected in series through common ports designated at 49*a*, 50*a*, 52*a* and 54*a* and also at 49*b*, 50*b*, 52*b* and 54*b*, and an operating hydraulic circuit is constituted between hydraulic pump, oil tank T and hydraulic cylinders.

Further, SOL-15 through SOL-19 designate solenoids for the control valves; A7 and B7 designate operating push-button switches for the hydraulic cylinder C7; A8 and B8 designate operating push-button switches for the hydraulic cylinder C8; and A9 and B9 designate operating push-botton switches for the hydraulic cylinder C9. The push-botton switches A7-A9 are used to extend the piston rods of the hydraulic cylinder C7-C9 and the push-button switches B7-B9 are used to retract the piston rods of the hydraulic cylinders C7-C9. These electric parts are connected as shown to constitute an operating electric circuit.

The condition of the above-described arrangement shown in FIG. 13 is such that the normally opened control valves NO6 and NO7 are opened while the normally closed control valves NC10-NC12 are closed, so that pressure oil from the hydraulic pump P is not fed to the hydraulic cylinders C7-C9. That is, in this condition, even if the hydraulic pump is operated, oil will flow back to the tank T.

Figure 14:
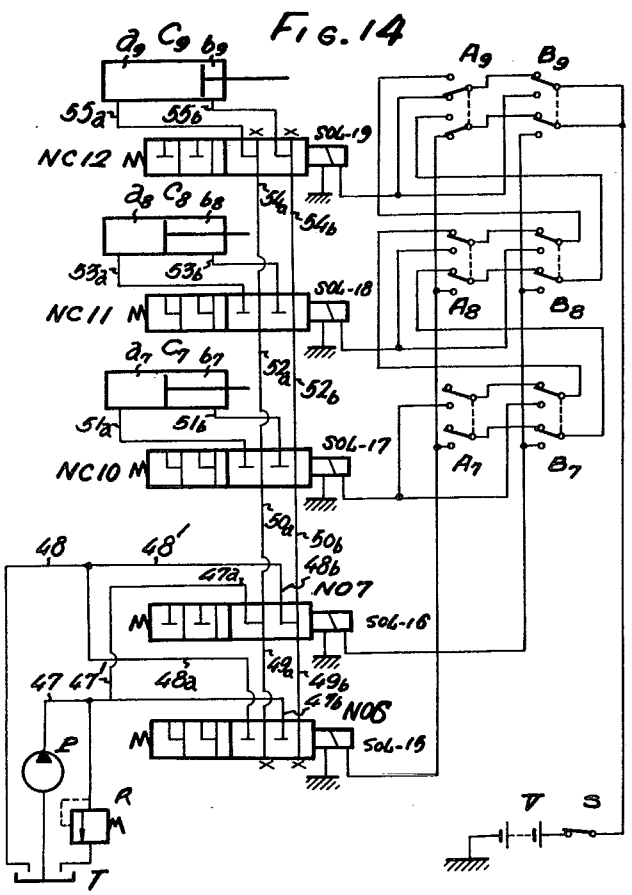

In order to operate a hydraulic cylinder, e.g., C9, the power switch S is first turned on. the push-button switch A9 is then turned on, whereupon the solenoids SOL-15 and SOL-19 are energized, thus switching the control valves NO6 and NC12, as shown in FIG. 14. As a result, the pressure oil from the hydraulic pump P flows successively through a line 47, the ports 47' and 47*a* of the control valve NO7, common ports designated at 50*a*, 52*a* and 54*a* and the port 55*a* of the control valve NC12 into the rear piston chamber a9 of the hydraulic cylinder C9. Along with this, the oil in the front piston chamber b9 flows successivly through the port 55*b* of the control valve NC12, common ports designated at 54*b*, and 52*b* and 50*b* and the ports 48*b* and 48' of the control valve NO7 back into the oil tank T. Therefore, the piston rod of the hydraulic cylinder C9 is extended to the right.

When the push-button switch A9 is turned off, the solenoids SOL-15 and SOL-19 are deenergized, thus switching the control valves NO6 and NC12 to their normal conditions. Thereafter, no pressure oil is fed to the hydraulic cylinder C9, so that the piston rod stops extending and is held in its position.

Figure 15:
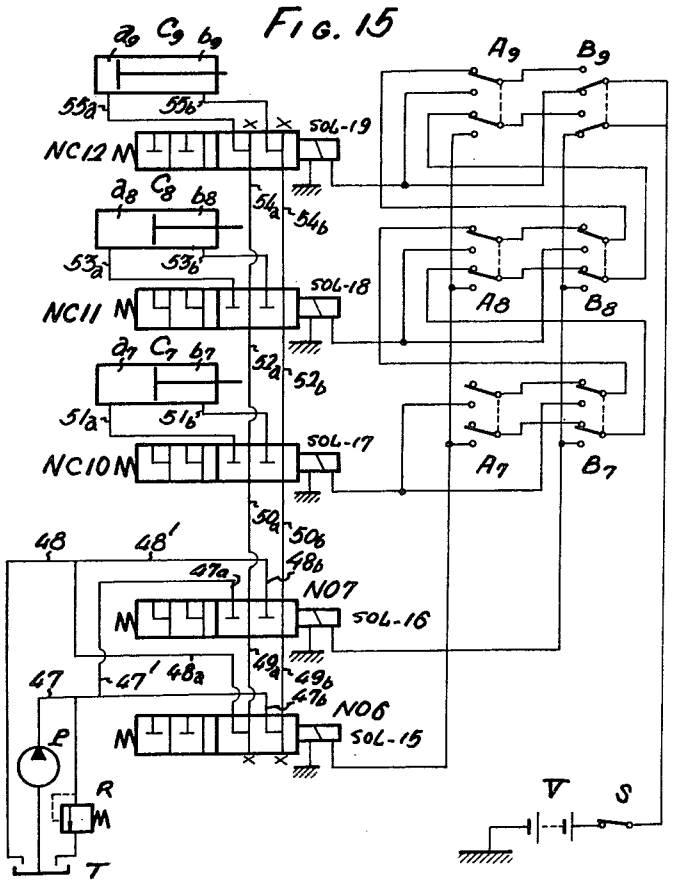
FIGS. 14 and 15 are electric-hydraulic combination circuit diagrams showing the operating conditions of the embodiment shown in FIG. 13.

In order to retract the piston rod, the push-button switch B9 is turned on, as shown in FIG. 15, whereby the solenoids SOL-16 and SOL-19 are energized, thus switching the control valves NO7 and NC12. As a result, the pressure oil from the hydraulic pump P flows successively through a line 47, the port 47*b* of the control valve NO6, common ports designated at 49*b*, 50*b*, 52*b* and 54*b* and the port 55*b* of the control valve NC12 into the front piston chamber b9. On the other hand, the oil in the rear piston chamber a9 flows successively through the port 55*a* of the control valve NC12, common ports designated at 54*a*, 52*a*, 50*a* and 49*a*, the port 48*a* of the control valve NO6 and a line 48 back into the oil tank T. Therefore, the piston rod of the hydraulic cylinder C9 is retracted to the left.

When the push-button switch B9 is turned off, the solenoids SOL-16 and SOL-19 are deenergized, thus switching the control valves NO7 and NC12 to their normal conditions. Thereafter, no pressure oil is fed to the hydraulic cylinder C9 so that the piston rod stops retracting and is held in its position.

The above refers to a series of operations of the hydraulic cylinder C9. In this embodiment also, it is possible to control any desired number of lines of hydraulic cylinders by connecting sets each comprising one hydraulic cylinder and one normally closed control valve to a basic circuit comprising two-in-a-set normally opened control valves.

Figure 16:
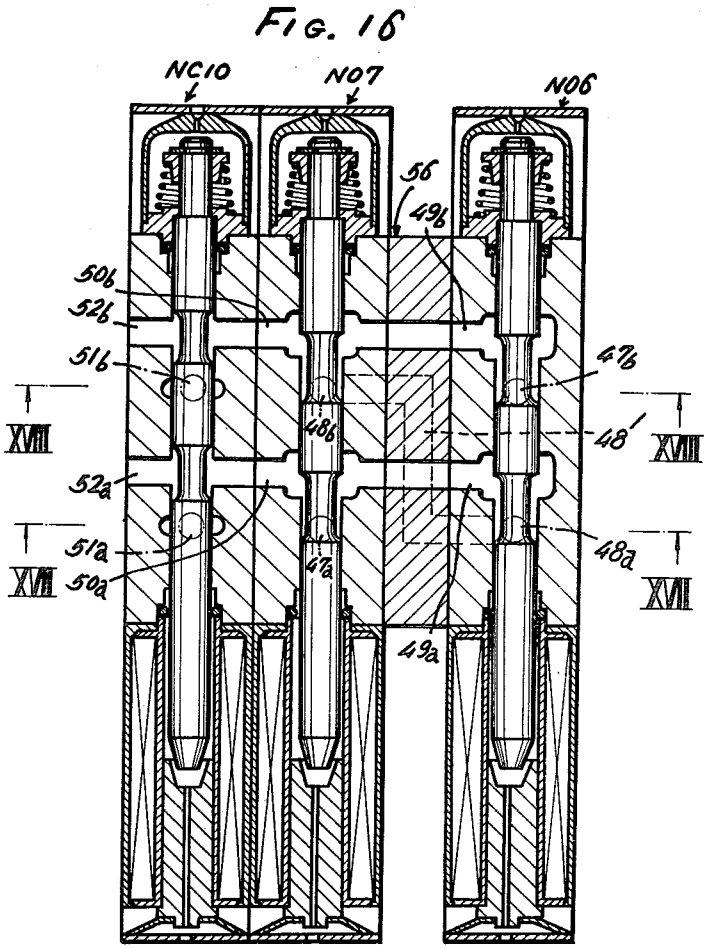
FIG. 16 is a plan view, in longitudinal section, showing how the control valves shown in FIG. 13 are stacked.
Figure 18:
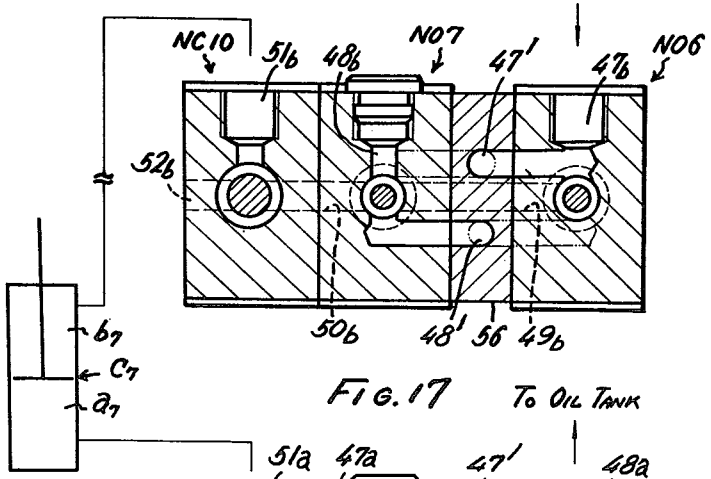
FIG. 18 is a sectional view taken along the line XVIII—XVIII of FIG. 16.
Figure 17:
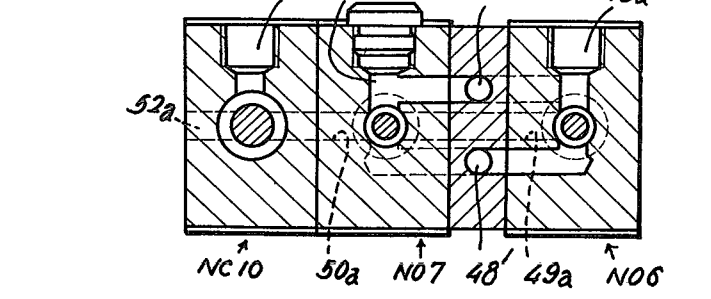
FIG. 17 is a sectional view taken along the line XVII—XVII of FIG. 16.

That is, as can be understood from FIGS. 16 through 18 showing how the control valves shown FIG. 13 are stacked, two normally opened control valves NO6 and NO7 constituting a basic circuit with a spacer 56 interposed therebetween and normally closed control valves NC10–NC12 associated with hydraulic cylinders C7–C9 which are objects of control are stacked so that they communicate with each other through common ports designated at 49*a*, 50*a*, 52*a*, 54*a*, and 49*b*, 50*b*, 52*b*, 54*b*. Alternatively, the basic circuit and the normally closed control valves may be separated from each other and then connected through pipes while the basic circuit may be disposed on a suitable operating board and the normally closed control valves may be disposed integrally with or in the vicinity of the associated hydraulic cylinders. In either case, these control valves can be connected in series because of the presence of the common ports, whereby the effect of reduction and simplification of connector pipes in the hydraulic control apparatus is remarkable.

As has been described so far, the hydraulic control apparatus according to the present invention is constituted by a combination of two kinds of control valves, i.e., normally opened and normally closed control valves. Therefore, the cross-sectional shape of the sleeves of the control valves are simple and small, so that improvements in machinability and hence in reliablility can be expected. Further, by making full use of the hydraulic and electric circuits, it is possible to develop applied circuits for various types of sophisticated control, such as sequence control and composite operation control. Further, not only directional control but also other various types of control can be achieved by adding a control valve having a function other than NO and NC, e.g., a throttle valve.

I claim:

1. A hydraulic control apparatus comprising normally opened and normally closed, solenoid operated, spring return type, two-direction, two-position directional control valves, said valves comprising:

(a) a sleeve having a rectangular parallelepipedic cross-section, an upper and lower surface, each being at least partially flat; two opposed lateral surfaces, each being at least partially flat, said sleeve having an axially extending cylindrical void therein and ports including at least one port for communicating said void with one of said surfaces, and at least one common port for communicating each of said lateral surfaces with each other and with said void;

(b) a spool held within said void and being slidably movable therein, said spool having land portions having an external diameter approximately equal to the internal diameter of said cylindrical void, and a reduced portion having an external diameter smaller than the internal diameter of said cylindrical void;

a solenoid mounted on one end of said sleeve;

a U-shaped clamp elastically secured to said sleeve, covering said solenoid;

a conical coil spring mounted on the opposite end of said sleeve from said solenoid; and a U-shaped clamp elastically secured to said sleeve, covering said spring, wherein said components are arranged such that said spool is slidably moved within said void by said solenoid in order to open or close communication between at least one of said ports and at least one of said common ports, a plurality of valves being interconnected at said flat surfaces in series through at least one of their respective common ports.

2. A hydraulic control apparatus as in claim 1 wherein said valves are 3-port, 2-position control valves.

3. A hydraulic control apparatus as in claim 1 wherein said valves are 6-port, 2-position control valves.

* * * * *